United States Patent [19]

Parslow et al.

[11] Patent Number: 4,464,272

[45] Date of Patent: Aug. 7, 1984

[54] FABRIC SOFTENING COMPOSITION

[75] Inventors: Michael W. Parslow, Upton by Chester; Edwin Willis, Wirral, both of England

[73] Assignee: Lever Brothers Company, New York, N.Y.

[21] Appl. No.: 460,715

[22] Filed: Jan. 24, 1983

[30] Foreign Application Priority Data

Feb. 10, 1982 [GB] United Kingdom ..... 8203883

[51] Int. Cl.[3] ..... D06M 13/46

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,177,149 | 4/1965 | Wood et al. | 252/153 |
| 3,822,312 | 7/1974 | Sato et al. | 252/527 |
| 4,110,498 | 8/1978 | Benjamin et al. | 428/35 |

FOREIGN PATENT DOCUMENTS

| | | | |
|---|---|---|---|
| 1030308 | 5/1978 | Canada . | |
| 13780 | 12/1979 | European Pat. Off. | 252/8.8 |
| 55-080499 | 6/1980 | Japan . | |
| 767771 | 2/1957 | United Kingdom . | |
| 1133870 | 11/1968 | United Kingdom . | |
| 1414030 | 11/1975 | United Kingdom . | |
| 2007734 | 5/1979 | United Kingdom . | |

*Primary Examiner*—Maria Parrish Tungol

*Attorney, Agent, or Firm*—Milton L. Honig; James J. Farrell

[57] ABSTRACT

A fabric softening composition having a viscosity of less than 150 cP, preferably less than 100 cP comprises an aqueous base, a cationic fabric softener and lanolin. The compositions may optionally contain viscosity control agents and nonionic emulsifying agents. Preferred compositions contain 0.5 to 30% cationic softener and 0.25 to 40% lanolin, the ratio of cationic softener to lanolin being from 20:1 to 1:20. The lanolin may be replaced by a lanolin-like material such as derivatives thereof or one or more of the active constituents of lanolin either extracted therefrom or derived from other sources. The presence of lanolin in the composition improves the viscosity and performance thereof.

5 Claims, No Drawings

FABRIC SOFTENING COMPOSITION

FIELD OF THE INVENTION

The present invention relates to a low viscosity liquid fabric softening composition. In particular, but not exclusively, it relates to an aqueous based concentrated fabric softening composition.

BACKGROUND ART

It is known to treat fabrics, particularly after washing, with fabric softening agents in order to improve the feel of the fabrics and, in the case of clothes, to improve the comfort in wear. Traditionally, fabric softening agents are applied from an aqueous liquor which is made up by adding a relatively small volume of a fabric softening composition to a large volume of water, for example during the rinse cycle in an automatic washing machine. The fabric softening composition is usually an aqueous liquid product containing less than about 8% of a cationic fabric softening agent. For a number of reasons, including for example the cost of packaging, it would be preferred if the product were to contain more than 8% of the active ingredient. However, due to the difficulty of making low-viscosity liquid products containing more than 8% of the active ingredient and due to difficulties in the storage and ease of use of such concentrated products, it has only been possible to do this in the past with the use of expensive ingredients and/or with the use of ingredients which have some undesirable effect on the properties of the product.

Further, there may be a desire to partially replace the cationic fabric softening agent with a material which is less costly, easier to handle or less prone to causing skin reaction while at the same time maintaining or substantially maintaining the performance of the product.

As set out in more detail below, the present invention seeks to overcome one or more of the objectives referred to above by the combined use of a cationic fabric softening agent and lanolin or a lanolin-like material.

SUMMARY OF THE INVENTION

According to the invention there is provided a low-viscosity, liquid fabric softening composition comprising an aqueous base, at least 0.5% by weight of a cationic fabric softening agent, and optionally other ingredients, the composition being characterised by further containing at least 0.25% by weight of lanolin or a lanolin-like material.

The term "low-viscosity" as used herein means that the viscosity of the fabric softening compositions is less than 150 cP, preferably less than 120 cP. This viscosity is measured at 25° C. and 110 $sec^{-1}$ in a Haake Viscometer.

An essential component of the present invention is lanolin or a lanolin-like material. Lanolin is wool wax which has been purified by various purification steps including washing, neutralisation, filtration, bleaching and deodorisation. Lanolin is composed primarily of esters which constitute the active constituents in the present invention and which yield on hydrolysis a mixture of complex alcohols and fatty acids. The alcohols which form about half of the ester component by weight, include sterols and terpene alcohols. The sterols amount to about 30% and include cholesterol, 7-dehydrocholesterol and cerebosterol and dihydrocholesterol (cholestanol). The terpene alcohols include lanesterol ($C_{30}H_{50}O$), dihydrolanesterol ($C_{30}H_{52}O$), agnosterol ($C_{30}H_{48}O$), dihydroagnosterol ($C_{30}H_{50}O$).

Lanolin is available commercially in a number of forms. Lanolin as such contains the active constituents primarily in their ester form. It is also available in two hydrolysed forms where the active constituents are primarily in their alcoholic or carboxylic acid form. Further, lanolin may be hydrogenated to form a product where the active constituents are present primarily only in their alcoholic form. Lanolin is also commercially available in propoxylated and acetylated forms. As used herein the term "lanolin" is intended to refer to any such material derived from wool wax whether the active constituents are in the alcoholic, ester, alkoxylated, hydrogenated or other chemical form.

Suitable commercial forms of lanolin include Corona (lanolin BP), Hartolan, Polychol and Coronet (Trade Marks of Croda Chemicals Ltd), Solulan, Acetulan and Modulan (Trade Marks of American Cholesterol Products Inc) and Lanocerina (Trade Mark - Esperis Spa Milan). Commercial lanolin is also available from Westbrook Lanolin Co., Bradford, England.

Many of the active constituents of lanolin can be prepared synthetically, from sources other than wool wax, or can be extracted from wool wax and other naturally occurring materials. While for cost reasons the commercially available forms of lanolin are preferred for the present invention, it is also possible to use any one or more of the active constituents referred to above, however derived, and also materials of similar structure. Thus, in place of lanolin one may use a "lanolin-like material" which term as used herein includes (a) any one or more of the active lanolin constituents referred to above, and the carboxylic acid or alcohol derivatives thereof;

(b) the corresponding carboxylic acids or alcohols and ester derivatives of the materials listed in (a), in particular the esters thereof with fatty acids or alcohols containing at least 12 carbon atoms.

(c) iso and anteiso- alcohols and acids and derivatives thereof having the general formula

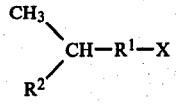

where $R^1$ is a divalent straight or branched chain, saturated or unsaturated, substituted or unsubstituted hydrocarbyl group having at least 7, preferably at least 15 carbon atoms, $R^2$ is a methyl or ethyl group and X is—OH, —COOH,

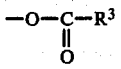

or —$COOR^3$ where $R^3$ is a hydrocarbyl group, in particular a fatty acid alkyl group containing of at least 2 carbon atoms. Examples of materials in this group include 16-methyl heptadecanol, 24-methyl hexacosanol, 8-methyl nonionic acid; and 2-hydroxy-16-methyl heptadecanoic acid.

The level of lanolin or lanolin-like material in the aqueous fabric softening compositions is at least 0.25% by weight, preferably not more than 40% by weight, such as between 1.5% and 20% by weight of the composition. Ideally the compositions contain at least 2% lanolin or lanolin-like material. In concentrated products the compositions may contain more than 10% lanolin or lanolin-like material.

Any well-known cationic fabric softening agent can be used in the present invention, as well as mixtures of two or more of such agents.

Suitable examples of cationic fabric-softening agents are quaternary ammonium compounds containing two long alkyl or alkenyl chains with 12–22 carbon atoms such as di(hardened or unhardened tallow) dimethyl ammoniumchloride, 2-heptadecyl-2methylstearoyl amido ethyl imidazoline methosulphate, di-(coco)-dimethyl ammoniumchloride, etc. These cationic fabric-softening agents are well-known in the art and further suitable examples can be found in Schwartz-Perry: "Surface-active Agents and Detergents" Vol II, 1958.

Relatively water-soluble cationic softening agents, such as the monoalkyl quaternary ammonium compounds such as stearyltrimethylammoniumchloride, may also be used, but, as they are often less effective softeners, they are preferably used in conjunction with other, more effective cationic softening agents or with non-cationic softening agents such as fatty acid esters of polyols such as sorbitantristearate, glycerolmonostearate, and so on, or with anionic detergents with which they are capable of forming softening complexes, such as fatty acid soaps. They may also be made more hydrophobic by treatment with suitable hydrophobising agents such as long chain alcohols and fatty acids. The present invention is however of particular benefit if the more effective, less water-soluble cationic softening agents having two long alkyl chains are used.

The level of cationic fabric softening agent in the aqueous fabric softening compositions is at least 0.5% by weight, preferably from not more than 30% by weight, such as between 1.0% and 15% by weight of the composition.

The ratio by weight of the cationic fabric softening agent to the lanolin or lanolin-like material may lie between 0.05:1 and 20:1, more preferably between 0.1:1 and 0 10:1, especially between 1:1 and 4:1.

In use, the fabric softening composition of the invention is added to a large volume of water to form a liquor with which the fabrics to be treated are contacted. Generally, the total concentration of the cationic fabric softening agent and the lanolin or lanolin-like materials in this liquor will be between 50 ppm and 500 ppm.

The pH of the aqueous composition used for forming the liquor may be varied within a somewhat wider range, for example between 3 and 8, preferably from 4 to 6. To achieve the desired pH in the composition and in the treatment liquor, the composition may contain buffering agents as required, such as benzoic acid, citric acid and phosphoric acids and/or their alkali metal salts.

In use, the fabrics to be treated are contacted with an aqueous liquor to which the fabric softening composition is added, the ratio by weight of the fabrics to the liquor being preferably less than 25:1, most preferably between 10:1 and 4:1.

The aqueous liquor in contact with the fabrics may be at any convenient temperature. Successful results can be obtained when the liquor has a temperature between 0° C. and 60° C., preferably between 10° C. and 40° C.

The liquor and fabrics in contact therewith are preferably agitated during treatment.

The amount of cationic softening agent and lanolin or lanolin-like material deposited on the fabric depends on, inter alia, the concentration of these components in the treatment liquor, the treatment temperature, the degree of agitation, the treatment time and the nature of the fabric. Generally, a level of less than 0.5%, such as between 0.01% and 0.4% by weight in total of these components will be deposited, based on the weight of the dry fabric.

The balance of the composition comprises the aqueous medium, as the case may be with the other ingredients as set out below. The aqueous medium comprises at least 25%, preferably at least 30%, and especially at least 40% of the composition.

The compositions of the invention may further comprise additional beneficial ingredients, commonly used or proposed for inclusion in liquid fabric-softening compositions. Such ingredients, either alone or incorporated in suitable carriers, include additional viscosity modifiers, germicides, fluorescers, perfumes including deodorising perfumes, organic or inorganic acids, antistatic agents such as water-soluble cationic surfactants, ethoxylated quaternary polyamine compounds (e.g. Ethoduameen T 13) and aluminium salts, soil-release agents, colourants, antioxidants, bleaches, bleach precursors, anti-yellowing agents, ironing aids etc, all in the conventional minor amounts. Enzymes such as cellulases may also be included.

The compositions may also contain, in addition to the cationic fabric-softening agents, other non-cationic fabric-softening agents such as nonionic fabric-softening agents.

In particular, the fabric softening compositions may include a viscosity modifier selected from polymers as described below, $C_{12}$–$C_{40}$ hydrocarbons, $C_9$–$C_{24}$ fatty acids, fatty acid esters having a total of 10–40 carbon atoms, $C_{10}$–$C_{18}$ fatty alcohols, water-miscible solvents, and electrolytes.

The polymer when included in the composition of the invention may be present therein in an amount of from 0.5 to 40%, preferably from 1 to 30%, and particularly preferably 4–25%. The polymer, suitable for inclusion, is defined in the following way:

The polymer should be water-soluble under user's conditions, and a 20% aqueous solution of the polymer conditions, and a 20% aqueous solution of the polymer should have a viscosity ($\eta$) of $<50$, preferably $<30$ and especially preferably $<15$ cP, as measured at 25° C. and 110 $sec^{-1}$ in a Haake Viscometer. Said 20% aqueous solution should also show a vapour pressure equal to or lower than the vapour pressure of a 2% aqueous solution of polyethyleneglycol with a molecular weight of 6,000, preferably equal to or lower than that of a 10% aqueous solution of said polyethyleneglycol, and particulary preferably equal to or lower than that of an 18% aqueous solution of said polyethyleneglycol. The said aqueous polymer solution can be of water and polymer only, or can include solvent-containing media normally derived from the raw materials or additives, or include additives specifically designed to improve the vapour pressure lowering capacity of the polymer, or, in the case of ionic polymers, include adjustments to pH in order to optimise ionisation. Such vapour pressure measurements can be obtained using an Hewlett Packard vapour pressure osmometer, using an operating temperature of 34.5° C. or using any other suitable vapour measuring device.

The polymer should furthermore have a molecular weight of at least 400, preferably at least 4,000 and particularly preferably at least 6,000.

It is desirable, furthermore, that the polymer does not negatively interact with any of the other ingredients of the composition.

Suitable examples of the polymer can be thus obtained from the polyalkyleneglycols, the polyalkylene imines, dextran, gelatin and other natural or synthetic (co)polymers, as long as they meet the above criteria.

Mixtures of two or more polymers of the same type or of different type may also be used.

A preferred class of polymers comprises polyethyleneglycols with an average molecular weight of about 1,000 to about 6,000. These polymers, and especially those with an average molecular weight of 4,000 or 6,000, are particularly suitable for compositions of the invention with a high level of relatively water-insoluble cationic fabric-softening agent.

Other typical examples of suitable polymers are dextran with a molecular weight of 10,000 and polyethylene imine with a molecular weight of 45–750.

When the composition contains a $C_{12}$–$C_{40}$ hydrocarbon as a viscosity control agent, this is advantageously at a level of from 0.25% to 50% by weight, preferably from 0.5% to 25%. Preferred materials have from 12 to 24 carbon atoms and especially preferred are liquid mixtures of paraffins having from 14 to 18 carbon atoms.

Normally, suitable hydrocarbons are found in the paraffin and olefin series, but other materials, such as alkynes and cyclic hydrocarbons are not excluded. Materials known generally as paraffin oil, and petroleum are suitable. Examples of specific materials are hexadecane, octadecane, eicosane tetradecane and octadecane. Preferred commercially-available paraffin mixtures include spindle oil and light oil and technical grade mixtures of $C_{14}$–$C_{18}$ n-paraffins. Haloparaffins such as myristyl chloride and stearyl bromide are not excluded.

When the composition contains a $C_9$–$C_{24}$ fatty acid, this is advantageously at a level of from 0.5 to 15%.

Highly preferred materials of this class are the $C_{10}$–$C_{20}$ saturated fatty acids, especially lauric acid, myristic acid, palmitic acid and stearic acid.

When the composition contains a fatty acid ester having a total of 10 to 40 carbon atoms this is at a preferred level of from 0.25 to 15% by weight, advantageously 0.5 to 4%. The ester is preferably empirically derived from a fatty acid having 8 to 23 carbon atoms and an alkanol or hydroxy alkanol having 1–8, especially 1–4 carbon atoms. Specific examples include esters derived from $C_1$–$C_3$ alcohols and lauric, myristic, palmitic or stearic acid, such as methyl laurate, ethyl myristate, iso-propyl stearate, ethylene glycol monostearate, ethyl stearate, methyl palmitate, and other esters such as iso-butyl stearate and 2-ethylhexyllaurate, iso-octyl myristate.

When the composition contains a fatty alcohol having from 10 to 18 carbon atoms, this is preferably at a level of from 0.25 to 15% by weight.

Specific examples of this class are decanol, dodecanol, tetradecanol, pentadecanol, hexadecanol and octadecanol. The most preferred materials are lauryl and palmityl alcohols.

When the compositions contains as viscosity control agent a solvent this may be a lower alkanol, a glycol, a glycolether and the like. The solvent may be present at a level of up to 20% by weight, such as from 5% to 15% by weight. When the cationic fabric-softening agent is supplied in the form of an aqueous-alcoholic solution, that alcohol content is included in the above amounts, and if necessary only a small amount of extra alcohol is to be added. A suitable solvent is isopropanol.

The viscosity of the fabric softening composition may be controlled by the presence of an electrolyte. Preferably the electrolyte is a water-soluble non-surface active salt such as sodium chloride, sodium methosulphate, sodium benzoate, magnesium chloride, aluminium chlorhydrate or calcium chloride. The level of electrolyte will determine or be determined by the desired viscosity of the composition and the nature and concentration of other components in the composition. Typical levels are from about 100 to about 1000 parts per million, most preferably between about 200 and about 500 parts per million.

The fabric softening compositions optionally contain one or more nonionic emulsifying agents, such as the polymerised monoglycerides of long chain fatty acids having from 14 to 24 carbon atoms in the straight or branched saturated or unsaturated carbon chain, such as poly-monolauryl glyceride, poly-monostearyl glyceride, poly-monopalmityl glyceride or poly-monooleyl glyceride. Another suitable nonionic emulsifying agent is sorbitan monostearate.

These nonionic emulsifying agents are available commercially by the Trade Marks WITCONOL (Witco Chemicals Ltd) and SPAN (Atlas Chemical). The nonionic emulsifying agent may be present at a level from 0.5% to 9.5% by weight, such as from 2.4% to 6%.

When the compositions contain a water-insoluble emulsifying agent as described above, it will often be necessary to further include another viscosity control agent to reduce the viscosity below 150 cP.

In addition to the above-discussed components, compositions according to the invention can also include a water-soluble cationic or nonionic surfactant.

By water-soluble, it is meant that the surfactant has a solubility in water of pH 2.5 and 20° C. of greater than 10 g/l. Normally such materials are alkyl substituted ammonium salts having one $C_{12}$–$C_{24}$ alkyl chain, optionally substituted or interrupted by functional groups such as —0—,—COO—,—CONH—,—0—etc. Suitable water-soluble nonionic surfactants are the ethoxylated sorbitan esters available as TWEENS (Atlas Chemical).

It is particularly beneficial to include a water-soluble cationic or nonionic emulsifying agent in the composition if it contains as a viscosity modifier a hydrocarbon, fatty acid, fatty alcohol or fatty acid ester of the types referred to above. The level of the water-soluble surfactant is preferably 0.1% to 1%.

Preferably, the compositions contain substantially no anionic material such as anionic surfactants. However some anionic material may be tolerated in practice. In preferred compositions the weight ratio of any anionic material to the cationic fabric softening agent is less than 0.4:1, most preferably less than 0.2:1.

When the compositions contain a cationic fabric softening agent, lanolin or lanolin-like material and a nonionic emulsifying agent, in the absence of any further material or processing method to control viscosity, it has been found that composition viscosities below 150 cP cannot be achieved if the composition contains more than 2.1%, such as more than 2.4% cationic fabric softening agent, together with more than 14.0%, such as more than 16.0% lanolin or lanolin-like material and also more than 1.4%, such as more than 1.6% water-insoluble nonionic emulsifying agent.

The compositions of the invention can normally be prepared by mixing the ingredients together in water, heating to a temperature of about 60° C. and agitating for 5–30 minutes.

The invention will now be illustrated by the following non-limiting examples and comparative examples.

EXAMPLES 1 TO 22

Fabric conditioning compositions were made up according to the formulations given in the following Tables I to V, by mixing the ingredients together in water at about 60° C. and agitating. The cationic fabric softening agents were:

CFS 1—Arosurf TA 100 (100% active)
CFS 2—Arquad 2HT (82.35% active)
CFS 3—Varisoft 475 (75% active)
CFS 4—Di(soft tallow) imidazoline methosulphate The lanolin used in each case was pure lanolin BP (ex BDH).

The viscosity modifying agents used were:

VMA 1—n-$C_{14}$–$C_{17}$ paraffin (ex BP)
VMA 2—sodium chloride
VMA 3—Polyethylene glycol (MW 1.5K)
VMA 4—polyethylene glycol (MW 4K)
VMA 5—isopropanol
VMA 6—propylene glycol
VMA 7—aluminium chlorhydrate The water-soluble emulsifying agents used were;

WSE 1—Arquad 18 (50% active)
WSE 2—Tween 20 (ex Atlas Chemicals)

The water-insoluble emulsifying agents used were:

WIE 1—Witconol 18L (polymonoglyceride) ex Witco ChemicalsI
WIE 2—Span 60 (sorbitan monostearate) ex Atlas Chemicals.

In each example the viscosity was meansured using a Haake viscometer at $110^{-1}$ and at 25? C.

TABLE I

| INGREDIENT % | EXAMPLE NO 1 | 2 | 3 | 4 | 5 |
|---|---|---|---|---|---|
| CFS 1 | 2.0 | 4.0 | | | 2.5 |
| CFS 2 | | | 7.3 | 12.7 | |
| Lanolin | 8.0 | 6.0 | 9.5 | 9.5 | 9.5 |
| VMA 1 | | | | | 13.0 |
| WSE 1 | | | | | 0.7 |
| Water | | | balance to 100 | | |
| Viscosity cP | 24 | 29 | 118 | 63 | 68 |

TABLE II

| INGREDIENT % | EXAMPLE NO 6 | 7 | 8 | 9 | 10 |
|---|---|---|---|---|---|
| CFS 1 | | | 2.0 | | |
| CFS 2 | | | | 3.65 | 4.75 |
| CFS 3 | 8.0 | 8.0 | | | |
| Lanolin | 4.0 | 9.0 | 18.0 | 17.0 | 22.10 |
| Water | | | balance to 100 | | |
| Viscosity cP | 92 | 115 | 95 | 95 | 103 |

TABLE III

| INGREDIENT % | EXAMPLE NO 11 | 12 | 13 | 14 | 15 |
|---|---|---|---|---|---|
| CFS 1 | | 1.8 | 2.4 | | 3.0 |
| CFS 2 | 2.5 | | | | |
| CFS 4 | | | | 18.75 | |
| Lanolin | 11.0 | 13.5 | 18.0 | 6.25 | 20.0 |
| VMA 1 | 13.0 | 25.0 | 20.0 | | |
| VMA 2 | | | | 0.32 | 0.1 |
| VMA 4 | | | | 10.0 | |
| VMA 5 | | | | 4.5 | |
| VMA 6 | | | | 1.0 | |

TABLE III-continued

| INGREDIENT % | EXAMPLE NO 11 | 12 | 13 | 14 | 15 |
|---|---|---|---|---|---|
| WSE 1 | 0.7 | 1.0 | 1.0 | | |
| WIE 1 | | | | | 2.0 |
| Water | | | balance to 100 | | |
| Viscosity cP | 80 | 80 | 79 | 71 | 100 |

TABLE IV

| INGREDIENT % | EXAMPLE NO 16 | 17 | 18 | 19 |
|---|---|---|---|---|
| CFS 1 | 3.6 | 1.8 | 3.0 | |
| CFS 2 | | | | 2.5 |
| Lanolin | 24.0 | 12.0 | 20.0 | 11.0 |
| VMA 1 | | 10.0 | | 13.0 |
| VMA 2 | 0.2 | | 0.05 | |
| WSE 1 | | 0.7 | | 0.45 |
| WIE 1 | 2.4 | 1.2 | | |
| WIE 2 | | | 2.0 | |
| Water | | balance to 100 | | |
| Viscosity cP | 88 | 40 | 65 | 42 |

TABLE V

| INGREDIENT % | EXAMPLE NO: 20 | 21 | 22 |
|---|---|---|---|
| CFS 1 | — | 3.0 | |
| CFS 3 | 15.5 | — | — |
| Lanolin | 9.5 | 20.0 | 20.0 |
| VMA 7 | 0.3 | 0.5 | 1.0 |
| WIE 2 | — | 2.0 | 2.0 |
| Water | | balance to 100 | |
| Viscosity | 82 | 91 | 74 |

By way of comparison, the compositions according to the formulations given in Table VI were made up in the same way. In each case, the presence of the water-insoluble emulsifier in the absence of a viscosity control agent has yielded a viscosity above 150 cP. Compare Examples 15 to 18 where the presence of a water-insoluble emulsifier together with a viscosity control agent has yielded a viscosity below 150 cP.

TABLE VI

| INGREDIENT % | EXAMPLE A | B | C |
|---|---|---|---|
| CFS 1 | 2.4 | 2.4 | 3.0 |
| Lanolin | 16.0 | 16.0 | 20.0 |
| WIE 1 | 1.6 | | |
| WIE 2 | | 1.6 | 2.0 |
| Water | | balance to 100 | |
| Viscosity cP | 209 | 229 | 409 |

Similar results can be obtained when the lanolin BP is replaced by Coronet grade lanolin (ex Croda Chemicals) or lanolin P95 (ex Westbrook Lanolin Co). Also, similar results can be obtained when the sodium chloride is replaced by calcium chloride, magesium chloride or aluminium chlorhydrate. Further similar results can be obtained when Arquad 2T (ex Armak) is used as the cationic fabric softening agent.

EXAMPLES 23 and 24

The following fabric softening compositions were prepared using lanolin-like materials in place of lanolin per se.

| INGREDIENTS (%) | EXAMPLE NO: 23 | 24 |
|---|---|---|
| Arquad 2HT | 8.0 | 12.25 |
| Super Hartolan[1] | 3.0 | — |
| Iso-stearic acid[2] | — | 2.75 |
| Calcium chloride | 0.1 | 0.2 |
| Water | balance to 100 | |
| Viscosity at $110s^{-1}$(Cp) | 13 | 126 |

Notes:
[1]Distilled lanolin alcohols (ex Croda Chemicals)
[2]Iso-stearic acid (ex Emery)

Except as indicated otherwise, all percentages referred to herein are by weight based on the weight of the composition.

We claim:

1. A low viscosity, liquid fabric softening composition comprising an aqueous base, from at least 0.5% to about 30% by weight of a cationic fabric softening agent and from more than about 10% to about 40% by weight of lanolin or a lanolin-like material, the composition characterized by a viscosity less than 150 cP measured at 25° C. and 110 $sec^{-1}$ in a Haake viscometer.

2. A fabric softening composition according to claim 1, wherein the level of lanolin or lanolin-like material is such that the viscosity of the composition, as measured by the method described herein, is less than about 100 cP.

3. A fabric softening composition according to claim 1, wherein the weight ratio of said lanolin or lanolin-like material to said cationic fabric softening agent lies between about 0.05:1 and about 20:1.

4. A fabric softening composition according to claim 1, wherein the weight ratio of said lanolin or lanolin-like material to said cationic fabric softening agent lies between about 0.1:1 and about 10:1.

5. A fabric softening composition according to claim 1, wherein it contains from about 1% to about 15% of said cationic fabric softening agent and from more than about 10% to about 20% of said lanolin or lanolin-like material.

* * * * *